United States Patent [19]

Kikuchi et al.

[11] 4,450,379

[45] May 22, 1984

[54] CATHODE RAY TUBE

[75] Inventors: Masahiro Kikuchi, Yokohama; Hisashi Utena, Funabashi; Shinzo Takei, Tokyo, all of Japan

[73] Assignee: Sony Corporation, Tokyo, Japan

[21] Appl. No.: 498,584

[22] Filed: May 26, 1983

Related U.S. Application Data

[63] Continuation of Ser. No. 255,171, Apr. 17, 1981, abandoned.

[30] Foreign Application Priority Data

Apr. 30, 1980 [JP] Japan ..... 55-60437[U]

[51] Int. Cl.[3] ..... H01J 31/00

[52] U.S. Cl. ..... 313/477 HC

[58] Field of Search ..... 313/477 HC, 477 R, 481, 313/479

[56] References Cited

U.S. PATENT DOCUMENTS 4,230,966 10/1980 Compen ..... 313/477 HC 4,344,015 8/1982 Marschka ..... 313/466

*Primary Examiner*—David K. Moore

*Assistant Examiner*—K. Wieder

*Attorney, Agent, or Firm*—Hill, Van Santen, Steadman & Simpson

[57] ABSTRACT

A cathode ray tube includes an envelope consisting of a flat panel, a funnel and a neck. The flat panel has a phosphor layer and a conductive layer respectively coated on its inner surface and the funnel is provided with an anode button. An anode contactor is attached to the anode button at its inner end. In this case, the anode contactor consists of a base portion made of a flat plate and extended substantially along the inner surface of the funnel and a leaf contactor integrally extended from the base portion so as to resiliently contact with the conductive layer coated on the inner surface of the flat panel. The base portion of the anode contactor is provided with a projection near a portion from which the leaf contactor is extended, the projection contacting with the inner surface of the funnel, and provided with an insertion aperture at a portion opposite to the portion from which the leaf conductor is extended, the inner end of said anode button engaging with said insertion aperture.

4 Claims, 5 Drawing Figures

CATHODE RAY TUBE

This is a continuation of application Ser. No. 255,171, filed Apr. 17, 1981 now abandoned.

BACKGROUND OF THE INVENTION

1. Field of the Invention

The present invention relates generally to a cathode ray tube, and is directed more particularly to a flat panel type cathode ray tube.

2. Description of the Prior Art

In the art, a flat panel type cathode ray tube is constructed as shown in FIG. 1. That is, a panel 2, which has a phosphor layer (not shown) coated on its inner surface and is contacted with and sealed to the front end edge of a funnel portion 1 to which is a neck 3 having an electron gun (not shown) therein is coupled, is made flat of, for example, a glass plate, so that the mechanical accuracy thereof is high. Further, a phosphor screen, for example, color phosphor screen can be formed on the inner surface of the flat panel 2 by the printing technique so that the cathode ray tube can be mass-produced and hence made inexpensive. However, the application of a high voltage to the inner surface of the panel 2 of such a flat panel type cathode ray tube proposes a problem. Especially, in the case of a high brightness cathode ray tube used as a color projector or the like, high voltage and large current are used therein so that the application of high voltage to the inner surface of the flat panel becomes a problem.

That is, in the case of a cathode ray tube in which a panel 12 having along its peripheral edge a so-called skirt portion 12*a* curved towards a funnel 11 is sealed to the front open end of the funnel 11, a conductive layer 13 which is formed on the inner surface of the panel 12 and supplied with a high voltage is generally formed to also cover the inner surface of the skirt portion 12*a* of the panel 12. While, the inner end of an anode button 14 provided through the funnel portion 11 is engaged with an anode contactor 15 made of a resilient metal plate. This anode contactor 15 is extended along the inner surface of the funnel portion 11 to the panel 12 in such a manner that the plate surface of the anode contactor 15 is substantially along the conductive layer 13 coated on the inner surface of the skirt portion 12*a* and a contactor 15*a* formed at the free end of the anode contactor 15 resiliently contacts the conductive layer 13. Thus, the high voltage applied to the anode button 14 is applied through the anode contactor 15 to the conductive layer 13 coated on the inner surface of the panel 12.

With the cathode ray tube in which the panel 12 has the skirt portion 12*a* and the conductive layer 13 is extended to the inner surface of the skirt portion 12*a* as described above, since the plate surface of the contactor 15 made of the resilient metal leaf extends along the conductive layer 13 on the inner surface of the skirt portion 12*a* and the contactor 15*a* thereof contacts the conductive layer 13, the resiliency of the anode contactor 15 effectively contributes to the resilient contact between the anode contactor 15 and the conductive layer 13 to maintain good contact.

In the case of the flat panel type cathode ray tube described in connection with FIG. 1, since the panel 2 has no skirt portion along its peripheral portion, the contact between the anode contactor made of a resilient leaf and the conductive layer formed on the inner surface of the panel, which are described in connection with FIG. 2, is not in contact along the surface direction of the resilient leaf and hence it becomes difficult to make good resilient contact, which becomes a problem especially when it is applied to a high voltage and large current cathode ray tube.

In order to make good contact in the flat panel type cathode ray tube, if the contactor 15*a* provided at the free end of the anode contactor 15 made of the resilient leaf is bent inwards to be L-shaped and the bent end of the contactor 15 contacts the conductive layer on the inner surface of the flat panel, it is necessary that the length of the bent portion of the contactor be selected sufficiently long so as to obtain a sufficient resiliency which will contribute to the contact thereof with the conductive layer on the inner surface of the flat panel. This results in that the area of the panel on which the image of the contactor is projected increases and hence the ineffective area of the picture screen also increases.

OBJECTS AND SUMMARY OF THE INVENTION

Accordingly, an object of the present invention is to provide a flat panel type cathode ray tube free from the defects inherent to the prior art cathode ray tube.

Another object of the invention is to provide a flat panel type cathode ray tube in which the resilient contact of an anode contactor with a conductive layer formed on the inner surface of a flat panel can be utilized without increasing the ineffective area of a picture screen.

According to an aspect of the present invention, there is provided a cathode ray tube which comprises:

- an envelope consisting of a flat panel, a funnel and a neck;
- said flat panel having a phosphor layer and a conductive layer respectively coated on its inner surface, said funnel being provided with an anode button; and
- an anode contactor attached to said anode button at its inner end,
- said anode contactor consisting of a base portion made of a flat plate and extended substantially along the inner surface of said funnel and a leaf contactor integrally extended from said base portion so as to resiliently contact said conductive layer coated on the inner surface of said flat panel, said base portion of said anode contactor being provided with a projection near a portion from which said leaf contactor is extended, said projection contacting the inner surface of said funnel, and provided with an insertion aperture at a portion opposite to the portion from which said leaf conductor is extended and, the inner end of said anode button engaging said insertion aperture.

The additional, and other objects, features and advantages of the present invention will become apparent from the following description taken in conjunction with the accompanying drawings through which the like references designate the same elements and parts.

DESCRIPTION OF THE PREFERRED EMBODIMENT

An example of the flat panel type cathode ray tube according to the present invention will be hereinbelow described with reference to the attached drawings.

Figure 1:
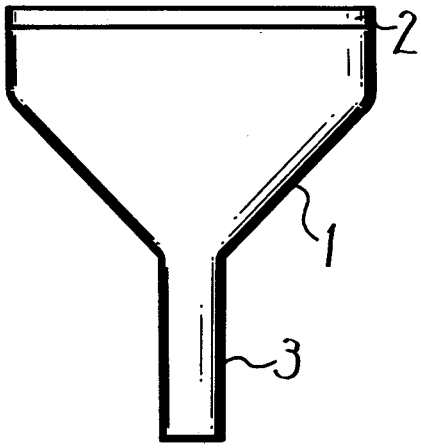
FIG. 1 is a side view showing schematically a flat panel type cathode ray tube.
Figure 2:
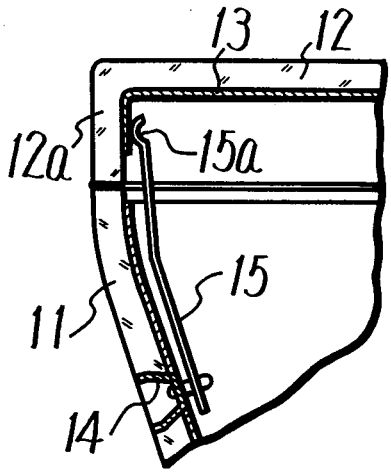
FIG. 2 is a cross-sectional view showing the essential part of a prior art cathode ray tube.
Figure 3:
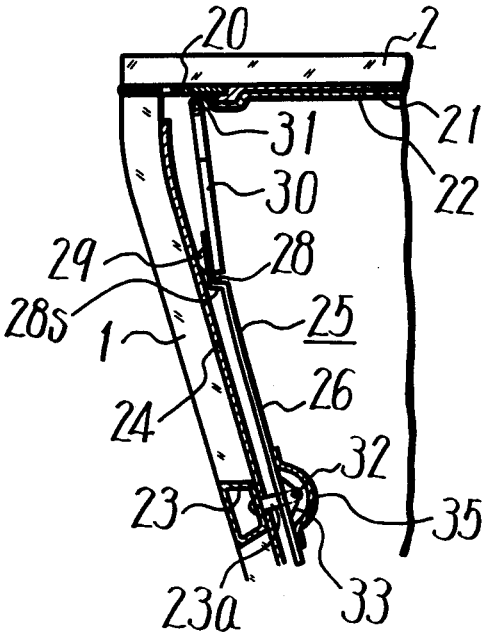
FIG. 3 is a cross-sectional view showing the essential part of an example of the flat panel type cathode ray tube according to the present invention.

FIG. 3 shows in cross-section the essential part of an example of flat panel type cathode ray tube according to the invention. In this example, on the inner surface of a flat panel 2 there is coated a conductive layer 20 in the shape of a frame along the periphery of the inner surface of the flat panel 2. A phosphor screen 21, which consists of a monochromatic phosphor or more than two-color phosphors, is coated on the inner surface of the flat panel 2 within the portion surrounded by the frame shaped conductive layer 20 and also on the conductive layer 20. A conductive layer 22 such as a vaporized aluminum layer or metal back layer is formed on the phosphor screen 21 to also cover a part of the frame-shaped conductive layer 20. Similar to an ordinary cathode ray tube, an anode cap (not shown), through which a high voltage is applied from the outside to the inside of the cathode ray tube, is engaged with the funnel portion 1, and a conductive anode button 23 is also embedded in the funnel portion 1 which will electrically engage with the anode cap. This anode button 23 electrically contacts a conductive layer 24 coated on the inner surface of the funnel portion 1.

According to the present invention, an anode contactor 25 having a specific construction is coupled to the inner end of the anode button 23 i.e. conductive projection 23*a* projected inwardly from the anode button 23 to the inside of the funnel portion 1. All of the anode contactor 25 is made of a single resilient metal plate or leaf as a unitary body.

Figure 4:
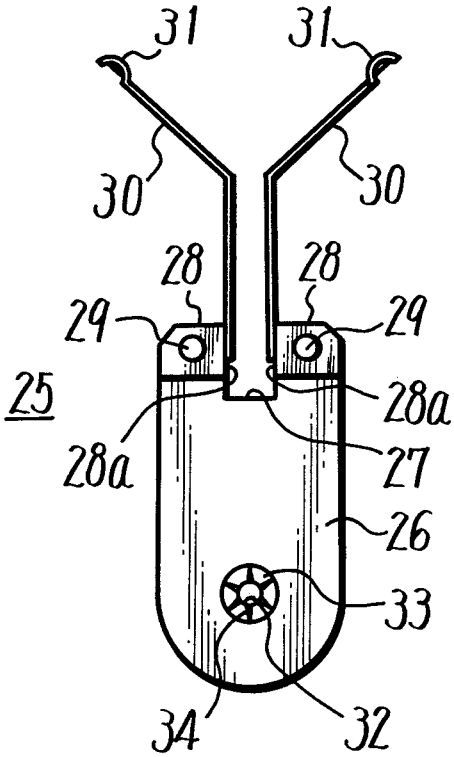
FIG. 4 is a front view showing an example of the anode contactor which is useable in the cathode ray tube of the invention shown in FIG. 3.
Figure 5:
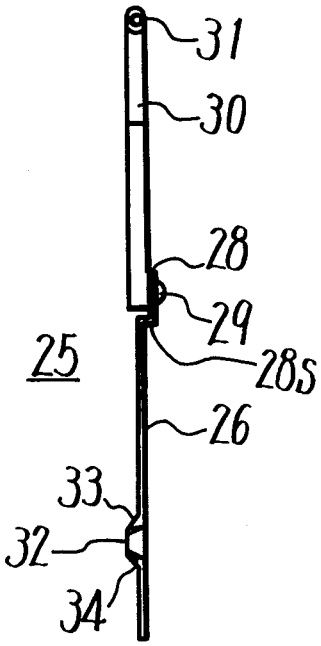
FIG. 5 is a side view of the anode contactor shown in FIG. 4.

As shown in FIGS. 4 and 5, the anode contactor 25 includes a base portion 26 made of a flat thin plate which is formed with a U-shaped recess 27 at the center of its one end edge. In the U-shaped recess 27, a pair of arm portions 28 are mounted at the one end portion of the base portion 26. These arm portions 28 are respectively bent on a line in the width direction of the base portion 26 and in the direction substantially perpendicular to the plate surface of the base portion 26 and then are again bent to be substantially parallel to the plate surface of the base portion 26 with steps 28s. Then, projections 29, each having a semi-spherical shape, are respectively formed by embossing on the arm portions 28 so they project from the side surfaces of the arm portion 28 remote from the surface of the base portion 26. On opposing edges 28*a* of both arm portions 28 in the recess 27 there are provided a pair of band-shaped leaf contactors 30 integral with the arm portions 28. The leaf contactors 30 each have their plate surface aligned at substantially right angles to the plate surface of the arm portions 28 in the direction opposite to the projecting direction of the semi-spherical projections 29 and each extend to the side opposite to the base portion 26. These leaf contactors 30 are bent at the middle portions thereof in a direction such that their free end portions expand, and at the free ends of the leaf contactors 30 there are respectively provided by embossing semi-spherical projections 31 which project in opposing directions. At the end portion of the base portion 26 opposite to its one end from which the leaf contactors 30 extend, there is provided an insertion aperture 32 into which the inner end of the anode button 23 i.e. conductive projection 23*a* can be inserted and engaged therewith. That is, a boss 33 is embossed at the portion of the base plate 26 in the direction opposite to the projecting direction of the projections 29, and then the aperture 32 is formed by boring at the center of the boss 33. In this case, a plurality of slits 34 are formed in the boss 33 in the radial direction from the aperture 32.

The anode contactor 25 constructed as above is attached within the cathode ray tube in such a manner that the projection 23*a* of the anode button 23 is inserted into the aperture 32 whereby the anode contactor 25 is fixed to the projection 23*a*. In this case, the plate surface of the base portion 26 of the anode contactor 25 is substantially in parallel to the inner surface of the funnel portion 1, and the leaf contactors 30 integrally elongated from the base portion 26 of the anode contactor 25 extend to the panel 2. In this case, also the boss 33 is engaged with the projection 23*a* to be projected in the direction to the projecting side of the projection 23*a*. In this example, if the diameter of the insertion aperture 32 is selected somewhat smaller than the diameter of the projection 23*a*, the peripheral edge of the insertion aperture 32 is expanded by the projection 23*a* due to the provision of the slits 34 in the boss 33 and hence the engagement of the projection 23*a* with the insertion aperture 32 will be resilient. At this time, the projections 29 respectively provided on the arm portions 28 resiliently contact the inner surface of the funnel portion 1 i.e. the conductive layer 24 coated thereon, which serves to position the pair of the leaf contactors 30. Thus, the end portions of the pair of the leaf contactors 30 are arranged to extend along the periphery of the inner surface of the flat panel 2 and the projections 31 at the ends of the leaf contactors 30 make contact with the conductive layer 20 coated on the peripheral portion of the inner surface of the flat panel 2 (in a certain case, the conductive layer 22). In this case, due to the distance between the anode button 23 and the flat panel 2, the length of the anode contactor 25 from its aperture 32 to the free ends of the leaf contactors 30 is selected so as to be suitable, and the anode contactor 25 is mounted on the inner end of the anode button 23 i.e. projection 23*a*. Under the above state, the pair of the leaf contactors 30 are expanded along the periphery of the flat panel 2, the plate surfaces of the leaf contactors 30 at their ends are extended substantially along the flat panel 2, and the projections 31 of the leaf contactors 30 are resiliently urged against the conductive layer 20 or 22 and will be in contact therewith.

According to the present invention constructed as above, the anode contactor 25 contacts with the inner surface of the funnel portion 1, and its position is determined and the free ends of the leaf contactors 30 of the anode contactor 25 substantially go along the inner surface of the flat panel 2 and make contact with the conductive layer 20 (and or 22) coated on the inner surface of the flat panel 2 with sufficient resilient force. Therefore, according to the invention, contact is positively made and hence the present invention is suitable for use with a high voltage, large current and high brightness cathode ray tube with good results.

In the above example of the invention shown in FIG. 3, reference numeral 35 designates an electro-magnetic shield body for the X-rays or the like, and it is cap-shaped and is previously attached by welding to the base portion 26 of the anode contactor 25 so as to surround the peripheral portion of the boss 3.

It will be apparent that many modifications and variations could be effected by one skilled in the art without departing from the spirits or scope of the novel concepts of the present invention, so that the spirits or scope of the invention should be determined by the appended claims only.

We claim as our invention:

1. A cathode ray tube, comprising, an envelope consisting of a flat panel, a funnel and a neck, said flat panel having a phosphor layer and a conductive layer respectively coated on its inner surface, said funnel being provided with an anode button, and an anode contactor attached to said anode button at its inner end on an axis of support, said anode contactor comprising an electrically conducting planar member having a first end and a second end formed with an opening near said first end through which said anode button extends to make electrical contact, a projection extending transversely from said second end of said planar member and making contact with the inner surface of said funnel, and a first planar flexible electrically conducting finger having two ends, one of said two ends extending from the second end of said planar member and orientated so that its width dimension lies in a plane which is at right angles to the plane of said planar member extending parallel with the funnel from the transversely extending projection and the other of said two ends of said first flexible finger moveable in a plane perpendicular to said axis of support and making flexible contact with said conductive layer on the inner surface of said flat panel.

2. A cathode ray tube according to claim 1 including a second flexible electrically conducting finger extending from said second end of said planar member and making flexible contact with said conductive layer on the inner surface of said funnel at a location different from where said first finger contacts said inner surface of said funnel and said second finger moveable in a plane perpendicular to said axis of support.

3. A cathode ray tube comprising an envelope consisting of a flat panel, a funnel and a neck, said flat panel having a phosphor layer and a conductive layer coated on its inner surface, an anode button mounted on a support axis to said funnel and having an anode contact attached thereto inside said tube, a planar electrical contact with a first end attached to said anode contact and a second end which extends toward said flat panel, and at least a first planar flexible finger having two ends, one of said two ends attached to said second end of said planar electrical contact and the other of said two ends in flexible contact with said conductive layer on said flat panel and said first finger moveable in a plane which is substantially perpendicular to said support axis and the second end of said flexible finger orientated so that its width dimension lies in a plane which is at right angles to said planar electrical contact.

4. A cathode ray tube according to claim 3 comprising a second flexible finger having two ends, one of said two ends attached to said second end of said planar electrical contact and the other of said two ends in flexible contact with said conductive layer on said flat panel and said second finger moveable in a plane which is substantially perpendicular to said support axis and said other ends of said first and second fingers spaced apart.

* * * * *